US005397672A

United States Patent [19]

Larson et al.

[11] Patent Number: 5,397,672

[45] Date of Patent: Mar. 14, 1995

[54] LIQUID DEVELOPER COMPOSITIONS WITH BLOCK COPOLYMERS

[75] Inventors: James R. Larson, Fairport; John W. Spiewak, Webster, both of N.Y.

[73] Assignee: Xerox Corporation, Stamford, Conn.

[21] Appl. No.: 113,626

[22] Filed: Aug. 31, 1993

[51] Int. Cl.[6] ..... G03G 9/135

[52] U.S. Cl. ..... 430/115

[58] Field of Search ..... 430/117, 110, 115

[56] References Cited

U.S. PATENT DOCUMENTS

| | | | |
|---|---|---|---|
| 3,985,663 | 10/1976 | Lu et al. | 430/117 |
| 4,707,429 | 11/1987 | Trout | 430/115 |
| 4,783,388 | 11/1988 | El-Sayed et al. | 430/115 |
| 4,873,388 | 10/1989 | Shutt et al. | 585/500 |
| 4,935,328 | 6/1990 | El-Sayed et al. | 430/115 |
| 5,019,477 | 5/1991 | Feider | 430/115 |
| 5,030,535 | 7/1991 | Drappel et al. | 430/116 |
| 5,034,299 | 7/1991 | Houle et al. | 430/115 |
| 5,045,425 | 9/1991 | Swidler | 430/115 |
| 5,187,037 | 2/1993 | Wilson et al. | 430/110 |

*Primary Examiner*—John Goodrow
*Attorney, Agent, or Firm*—E. O. Palazzo

[57] ABSTRACT

A liquid developer comprised of a liquid, thermoplastic resin particles, a nonpolar liquid soluble charge director, comprised of a quaternary ammonium block copolymer with hydroxide as the anion.

26 Claims, No Drawings

LIQUID DEVELOPER COMPOSITIONS WITH BLOCK COPOLYMERS

BACKGROUND OF THE INVENTION

This invention is generally directed to liquid developer compositions and, in particular, to a liquid developer containing quaternary ammonium block copolymers with hydroxide as the anion. The developers of the present invention can be selected for a number of known imaging and printing systems, such as xerographic processes, wherein latent images are rendered visible with the liquid developer illustrated herein. The image quality, solid area coverage and resolution for developed images usually require sufficient toner particle electrophoretic mobility. The mobility for effective image development is primarily dependent on the imaging system used. The electrophoretic mobility is primarily directly proportional to the charge on the toner particles and inversely proportional to the viscosity of the liquid developer fluid. A 10 to 30 percent change in fluid viscosity caused, for instance, by a 5° C. to 15° C. decrease in temperature could result in a decrease in image quality, poor image development and background development, for example, because of a 5 percent to 23 percent decrease in electrophoretic mobility. Insufficient particle charge can also result in poor transfer of the toner to paper or other final substrates. Poor or unacceptable transfer can result in, for example, poor solid area coverage if insufficient toner is transferred to the final substrate and can also lead to image defects such as smears and hollowed fine features. To overcome or minimize such problems, the liquid toners of the present invention were arrived at after extensive research efforts, and which toners result in, for example, sufficient particle charge for transfer and maintain the mobility within the desired range of the particular imaging system employed. Advantages associated with the present invention include increasing the desired negative charge on the developer particles and in embodiments providing a charge director, that is superior to similar charge directors, like quaternary ammonium block copolymers, lecithin, and metal salts of petroleum fractions. Some of the aforementioned additives like lecithin contain impurities which can have an adverse effect on their intended function. The superior charge can result in improved image development and superior image transfer.

A latent electrostatic image can be developed with toner particles dispersed in an insulating nonpolar liquid. The aforementioned dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet.

Useful liquid developers can comprise a thermoplastic resin and a dispersant nonpolar liquid. Generally, a suitable colorant, such as a dye or pigment, is also present. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 30 $\mu$m average by area size as measured using the Malvern 3600E particle sizer.

Since the formation of proper images depends, for example, on the difference of the charge between the toner particles in the liquid developer and the latent electrostatic image to be developed, it has been found desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising the thermoplastic resin, the nonpolar liquid and the colorant.

U.S. Pat. No. 5,019,477, the disclosure of which is hereby totally incorporated by reference, discloses a liquid electrostatic developer comprising a nonpolar liquid, thermoplastic resin particles, and a charge director. The ionic or zwitterionic charge directors may include both negative charge directors such as lecithin, oil-soluble petroleum sulfonate and alkyl succinimide, and positive charge directors such as cobalt and iron naphthanates. The thermoplastic resin particles can comprise a mixture of 1 (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene and (iv) selected from the group consisting of butadiene and acrylate. As the copolymer of polyethylene and methacrylic acid or methacrylic acid alkyl esters, NUCREL®, may be selected.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

U.S. Pat. Nos. 3,852,208 and 3,933,664 disclose colored, light-transparent photoconductive material which is obtained by a condensation reaction of organic photoconductive substances with reactive colored components. The chemical combination of an organic photoconductive substance having at least one amino or hydroxyl group with a color development component having at least one active halogen atom produces the color developing organic photoconductive materials. Alternatively, the color developing materials can be obtained from the combination of an organic photoconductive substance having at least one active halogen atom with a color developing component having at least one amino or hydroxyl group. The color developing organic photoconductive material may be pulverized in a ball-mill, a roll-mill or an atomizer to produce a toner for use as a dry or wet developing agent, or may be used in combination with other colored substances or vehicle resins.

U.S. Pat. No. 4,524,119 discloses electrophotographic dry development carriers for use with toner particles wherein the carrier core particles are coated with fluorinated carbon or a fluorinated carbon-containing resin. By varying the fluorine content of the fluorinated carbon, systematic uniform variation of the resistivity properties of the carrier is permitted. Suitable binders for use with the carrier core particles may be selected from known thermoplastics, including fluoropolymers.

U.S. Pat. No. 5,026,621 discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of block copolymer is oriented to the surface of the block polymer and the compatible segment thereof is oriented to be compatible with other resins and a coloring agent contained in the toner so that the toner is provided with both liquid repelling and solvent soluble properties.

U.S. Pat. No. 4,248,954 discloses carrier particles for use with a dry toner composition in an electrophotographic process, which are prepared by coating the surface of the carrier particles with a perfluoro carboxylic acid in a polymeric binder. The carrier particles are capable of imparting a positive triboelectric charge to toners used with these carrier particles.

U.S. Pat. No. 4,268,598 discloses a developing powder composition prepared by blending a fluoroaliphatic sulfonamido surface active agent with a desired formulation of toner powder particles. The toner powders are flowable, finely divided dry powder that are generally colored and are preferably conductive and magnetically attractable.

U.S. Pat. No. 4,139,483 discloses a finely divided dry toner composition comprising a colorant, a thermoplastic resin, and a surface active additive which is capable of providing a desired polarity and magnitude of triboelectric charging potential to the toner composition. The surface active additives are selected from highly fluorinated materials.

U.S. Pat. No. 4, 113,641 discloses a dry development powder with a high charge to mass ratio comprising a carrier particle treated with a perfluoroalkyl sulfonic acid. The core of the carrier particle is any material which can react chemically with perfluoro sulfonic acid, and is preferably a ferromagnetic material such as iron or steel.

U.S. Pat. No. 4,388,396 discloses developer particles comprising pigment particles, a binder and an offset-preventing agent selected from the group consisting of aliphatic fluorocarbon compounds and fluorochlorocarbon compounds. Electrical conductivity can be imparted to the developer by causing electrically conductive fine particles to adhere to the surfaces of the particles.

U.S. Pat. No. 4,468,446 discloses a dry electrostatographic toner for a pressure fixing process which comprises encapsulated toner particles with a pressure fixable adhesive core material containing a colorant and a pressure rupturable shell enclosing the core material, wherein the outer surface of the shell is an organofluoro compound.

Moreover, in U.S. Pat. No. 4,707,429 there are illustrated, for example, liquid developers with an aluminum stearate charge additive. Liquid developers with charge directors are also illustrated in U.S. Pat. No. 5,045,425. Further, stain elimination in consecutive colored liquid toners is illustrated in U.S. Pat. No. 5,069,995. Additionally, of interest are U.S. Pat. Nos. 4,760,009; 5,034,299 and 5,0288,508.

The disclosures of each of the U.S. patents mentioned herein are totally incorporated herein by reference.

In copending patent application U.S. Ser. No. 986,316 (D/91310), the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

In U.S. Pat. No. 5,308,731, the disclosures of which are totally incorporated herein by reference, there is illustrated a liquid developer comprised of a nonpolar liquid, thermoplastic resin particles, a nonpolar liquid soluble ionic or zwitterionic charge director, and a charge adjuvant comprised of an aluminum hydroxycarboxylic acid, or mixtures thereof; U.S. Pat. No. 5,306,591 discloses a liquid developer comprised of thermoplastic resin particles, a charge director, and a charge adjuvant comprised of an imine bisquinone; and U.S. Ser. No. 065,414 discloses a liquid developer comprised of thermoplastic resin particles, and a charge director comprised of an ammonium AB diblock copolymer of the formula

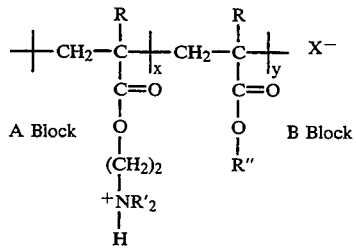

wherein $X^-$ is a conjugate base or anion of a strong acid, R is hydrogen or alkyl, R′ is alkyl, R″ is an alkyl group containing from about 6 to about 20 carbon atoms, and y and x represent the number average degree of polymerization (DP) wherein the ratio of y to x is in the range of from about 10 to 2 to about 100 to 20.

SUMMARY OF THE INVENTION

It is an object of the present invention to provide liquid developers with many of the advantages illustrated herein.

Another object of the present invention is to provide liquid developers capable of high particle charging and rapid toner charging rates.

Another object of the invention is to provide a negatively charged liquid developer wherein there are selected as charge directors quaternary ammonium AB diblock copolymers with hydroxide as the anion.

It is still a further object of the invention to provide a liquid developer wherein developed image defects such as smearing, loss of resolution and loss of density are eliminated, or minimized.

Also, in another object of the present invention there are provided negatively charged liquid developers with certain charge directors, which are superior in embodiments to, for example, quaternary ammonium block copolymers since, for example, with the hydroxide anion higher negative particle charge results in embodiments. The superior charge can result in improved image development and excellent image transfer.

Another object of the present invention resides in the provision of negatively charged liquid toners with quaternary ammonium block copolymers which have been treated to enhance their functionality and wherein in embodiments enhancement of the negative charge of NUCREL ® based toners, especially cyan and magenta toners, is enhanced.

These and other objects of the present invention can be accomplished in embodiments by the provision of liquid developers with certain charge directors. In embodiments, the present invention is directed to liquid developers comprised of a toner resin, pigment, and a charge additive comprised of quaternary ammonium block copolymers with hydroxide as the anion. In embodiments, the aforementioned charge director contains a quaternary ammonium group and a constituent or component that is nonpolar thereby enabling hydrocarbon solubility, and which block copolymers can be obtained by group transfer polymerization.

Embodiments of the present invention relate to a developer comprised of a liquid, thermoplastic resin particles, and a nonpolar liquid soluble ammonium block copolymer hydroxide charge director; and a liquid electrostatographic developer comprised of (A) a nonpolar liquid having a Kauri-butanol value of from about 5 to about 30, and present in a major amount of from about 50 percent to about 95 weight percent, (B) thermoplastic resin particles having an average volume particle diameter of from about 5 to about 30 microns, (C) a nonpolar liquid soluble quaternary ammonium block copolymer with a basic anion, and (D) optionally a charge adjuvant.

Suitable charge directors of the present invention can be represented by the formula

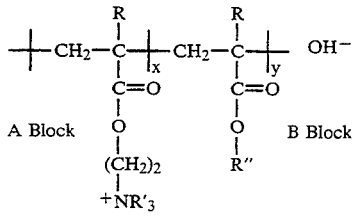

wherein R is alkyl or hydrogen; R′ is alkyl; and R″ is alkyl with from about 6 to about 20 carbon atoms and wherein y and x represent the number average degree of polymerization wherein the ratio of x toy is in the range of from about 10 to 2 to about 100 to 20. Examples of specific diblock copolymer charge directors include poly[2-trimethylammoniumethyl methacrylate hydroxide co-2-ethylhexyl methacrylate], poly[2-triethylammoniumethyl methacrylate hydroxide co-2-ethylhexyl methacrylate], poly[2-trimethylammoniumethyl methacrylate hydroxide co-2-ethylhexyl methacrylate], poly[2-trimethylammoniumethyl methacrylate hydroxide co-2-ethylhexyl acrylate], poly[2-trimethylammoniumethyl acrylate hydroxide co-2-ethylhexyl methacrylate], poly[2-trimethylammoniumethyl acrylate hydroxide co-2-ethylhexyl acrylate], poly[2-triethylammoniumethyl methacrylate hydroxide co-2-ethylhexyl acrylate], poly[2-triethylammoniumethyl acrylate hydroxide co-2-ethylhexyl acrylate], poly[2-trimethylammoniumethyl methacrylate hydroxide co-2-ethylhexyl acrylate], poly[2-trimethylammoniumethyl acrylate hydroxideco-2-ethylhexyl acrylate], poly[2-trimethylammoniumethyl methacrylate hydroxide co-N,N-dibutyl methacrylamide], poly[2-triethylammoniumethyl methacrylate hydroxide co-N,N-dibutyl methacrylamide], poly[2-trimethylammoniumethyl methacrylate hydroxide co-N,N-dibutylacrylamide], and poly[2-triethylammoniumethyl methacrylatehydroxide co-N,N-dibutylacrylamide].

Other examples of diblock copolymer charge directors include poly[4-vinyl-N,N-trimethylanilinium hydroxide co-2-ethylhexyl methacrylate], poly[4-vinyl-N,N-triethylanilinium hydroxide co-2-ethylhexyl methacrylate], poly[quaternary ethylenimmonium hydroxide co-2-ethylhexyl methacrylate], poly[quaternary propylenimmonium hydroxide co-2-ethylhexyl methacrylate], and polyvinyl-N-ethyl-pyridinium hydroxide-co-p-dodecylstyrene.

A preferred ammonium AB diblock copolymer charge director of this invention contains a polar A block with a positively charged quaternary ammonium nitrogen and a nonpolar B block which has sufficient aliphatic content to enable the block copolymer to more effectively dissolve in a nonpolar liquid having a Kauri-butanol value of less than about 30. The A block has, for example, a number average molecular weight range of from about 200 to about 10,000 and the B block has a number average molecular weight range of from about 2,000 to about 50,000. Number average degree of polymerization (DP) refers to the average number of monomeric units per polymer chain. It is related to the number average molecular weight ($M_n$) by the formula $M_n = M_0 \times DP$, where $M_0$ is the molecular weight of the monomer. Assuming an average $M_0$ of about 200 for both the A and B monomers, the above A block molecular weight ranges provide for a DP of about 1 to about 50, and the above B block molecular weight ranges provide for a DP of about 10 to about 250. Amine nitrogen alkylation to form the quaternary ammonium salt in the polar A block for satisfactory acceptable charge director performance is in embodiment at least 80 mole percent and preferably at least 90 mole percent.

In another embodiment, the AB quaternary ammonium hydroxide diblock charge director is composed of A and B blocks, wherein the A block is an alkyl, aryl or alkylaryl amine containing polymer wherein the alkyl, aryl, or alkylaryl moiety which can be substituted or unsubstituted. Useful A blocks are polymers prepared from at least one monomer selected from the group consisting of 1) $CH_2=CRCO_2R^1$ wherein R is hydrogen, alkyl, aryl, or alkylaryl of 1 to 20 carbons and $R^1$ is alkyl of 1 to 20 carbons where the terminal end of $R^1$ is of the general formula —$N(R^2)_3OH$— where N is nitrogen, $R^2$ is alkyl, cycloalkyl, aryl, or alkylaryl of 1 to 20 carbons; and 2) 2, 3, or 4-vinylpyridinium hydroxide wherein the ring carbon atoms not substituted with the vinyl group are substituted with $R^2$ and the ring nitrogen is substituted with R as defined above. Examples of monomers useful as A blocks include 2-(N,N-trimethylammonium hydroxide)ethyl methacrylate, 2-(N,N-triethylammonium hydroxide)ethyl methacrylate, 2-(N,N-trimethylammonium hydroxide)ethyl acrylate, 2-(N,N-trimethylammonium p-toluene-sulfonate)ethyl methacrylate, 4-vinyl-N-methyl-pyridinium hydroxide, 2-vinyl-N-ethyl-pyridinium hydroxide-3-vinyl-N-methyl-pyridinium hydroxide, and the like. Useful B blocks are polymers prepared from at least one monomer selected from the group consisting of butadiene, isoprene, and compounds of the general formulas, $CH_2=CHR^3$, $CH_2=CHCO_2R^3$, $CH_2=CRCO_2R^3$, where $R^3$ is alkyl of about 6 to about 30 carbons, or alkylaryl of 8 to 30 carbons. Examples of monomers useful in preparing B blocks include 2-ethylhexylmethacrylate, laurylmethacrylate, stearylmethacrylate, butadiene, isoprene, 1-dodecene, 2-ethylhexylacrylate, p-tert butylstyrene, and the like. Aryl includes 6 to about 30 carbon atoms, such as phenyl, benzyl, naphthyl and the like, and alkyl includes methyl, ethyl, propyl, butyl, pentyl, and the like.

In another embodiment, the AB quaternary ammonium hydroxide diblock charge director can be generated by an ion exchange method where the hydroxide ion is substituted for another anion such as bromide, chloride, or p-toluenesulfonate, which can be accomplished by a number of known processes including ion exchange columns and liquid-liquid ion exchange.

The charge director can be selected for the liquid developers in various effective amounts, such as for example from about 0.5 percent to 100 percent by weight relative to developer solids and preferably 2 percent to 20 percent by weight relative to developer solids. Developer solids include in embodiments toner resin, pigment, and optional charge director. Without pigment the developer may be selected for the generation of a resist, or a printing plate.

Examples of liquid carriers selected for the developers of the present invention include a liquid with an effective viscosity of, for example, from about 0.5 to about 500 centipoise, and preferably from about 1 to about 20 centipoise, and a resistivity greater than or equal to $5\times10^9$ ohm/centimeters, such as $10^{13}$ ohm/cm or more. Preferably, the liquid selected in embodiments is a branched chain aliphatic hydrocarbon. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are known and should have an electrical volume resistivity in excess of about $10^9$ ohm-centimeters and a dielectric constant below or equal to 3.0. Moreover, the vapor pressure at 25° C. should be less than or equal to 10 Torr in embodiments.

While the ISOPAR® series liquids are the preferred nonpolar liquids in embodiments for use as dispersants in the liquid developers of the present invention, the important characteristics of viscosity and resistivity can be achieved, it is believed, with other suitable liquids. Specifically, the NORPAR™ series available from Exxon Corporation, the SOLTROL® series from the Phillips Petroleum Company, and the SHELLSOL® series from the Shell Oil Company can be selected.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.:3 to 3 percent, and more preferably, 0.5 to 2.0 percent by weight.

Any suitable thermoplastic toner resin can be selected for the liquid developers of the present invention in effective amounts of, for example, in the range of 99 percent to 40 percent of developer solids, and preferably 95 percent to 70 percent of developer solids; developer solids includes the thermoplastic resin, optional pigment and charge director and any other optional components that comprises the particles. Examples of such resins include ethylene vinyl acetate (EVA) copolymers (ELVAX® resins, E. I. DuPont de Nemours and Company, Wilmington, Del.); copolymers of ethylene and an $\alpha$-$\beta$-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid and at least one alkyl ester of acrylic or methacrylic acid wherein alkyl is from 1 to about 20 carbon atoms like methyl methacrylate (50 to 90 percent)/methacrylic acid (0 to 20 percent)/ethylhexyl acrylate (10 to 50 percent); and other acrylic resins including ELVACITE® acrylic resins (E. I. DuPont de Nemours and Company); or blends thereof. Preferred copolymers are the copolymer of ethylene and an $\alpha$-$\beta$-ethylenically unsaturated acid of either acrylic acid or methacrylic acid. In a preferred embodiment, NUCREL® like NUCREL® 599, NUCREL® 699, or NUCREL® 960 are selected as the thermoplastic resin.

The liquid developer of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on the total weight of solids contained in the developer. The amount of colorant used may vary depending on the use of the developer.

Examples of colorants include pigments like carbon blacks like REGAL 330®, cyan, magenta, yellow, blue, green, brown and mixtures thereof; pigments as illustrated in U.S. Pat. No. 5,223,368, the disclosure of which is totally incorporated herein by reference, and more specifically, the following.

| PIGMENT BRAND NAME | MANU-FACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901 F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, CI 77266 |
| UHLICH ® BK 8200 | Paul Uhlich | Black |

To further increase the toner particle charge and, accordingly, increase the mobility and transfer latitude of the toner particles, known charge adjuvants in effective amounts of, for example, from 0.2 to 5 weight percent of solids of resin, pigment and charge adjuvant can be added to the toner particles. For example, adjuvants, such as metallic soaps like aluminum, magnesium stearate or octoate; fine particle size oxides, such as oxides of silica, alumina, titania, and the like; paratoluene sulfonic acid, and polyphosphoric acid may be added. Negative charge adjuvants increase the negative charge of the toner particle, while the positive charge adjuvants increase the positive charge of the toner particles.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is needed for effective image development and background cleaning.

Toner particle mobility can be measured using the electroacoustics effect, the application of an electric field, and the measurement of sound, reference U.S. Pat. No. 4,497,208, the disclosure of which is totally incorporated herein by reference. This technique is particularly useful for nonaqueous dispersions since the measurements can be made at high volume loadings, for example, greater than or equal to 1.5 to 10 weight percent. Measurements made by this technique have been shown to correlate with image quality, for example high mobilities can lead to improved image density, higher image resolution and improved transfer efficiency. Residual conductivity, that is the conductivity from the charge director, is measured using a low field device as illustrated in the following Examples.

The liquid electrostatic developer of the present invention can be prepared by a variety of known processes such as, for example, mixing in a nonpolar liquid the thermoplastic resin and colorant in a manner that the resulting mixture contains, for example, about 15 to about 30 percent by weight of solids; heating the mixture to a temperature from about 70° C. to about 130° C. until a uniform dispersion is formed; adding an additional amount of nonpolar liquid sufficient to decrease the total solids concentration of the developer to about 10 to 20 percent by weight; cooling the dispersion to about 10° C. to about 50° C.; adding the charge adjuvant compound to the dispersion; diluting the dispersion; and adding the charge director.

In the initial mixture, the resin, colorant and optional charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. Useful particulate media include particulate materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch, or about 1.0 to about 13 millimeters.

Sufficient, nonpolar liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant and resin. However, the temperature at which this step is undertaken should not be so high as to degrade the nonpolar liquid or decompose the resin or colorant when present. Accordingly, the mixture is heated to a temperature of from about 70° C. to about 130° C., and preferably from about 75° C. to about 110° C. The mixture may be ground in a heated ball mill or heated attritor at this temperature for about 15 minutes to about 5 hours, and preferably about 1 to about 3 hours.

After grinding at the above temperatures, an additional amount of nonpolar liquid may be added to the dispersion. The amount of nonpolar liquid to be added should be an amount sufficient to decrease the total solids concentration of the dispersion to from about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like, in a jacket surrounding the mixing vessel. Cooling may be accomplished, for example, in the same vessel, such as the attritor, while simultaneously grinding with particulate media to prevent the formation of a gel or solid mass, without stirring to form a gel or solid mass, followed by shredding the gel or solid mass and grinding by means of particulate media, or with stirring to form a viscous mixture and grinding by means of particulate media. The resin precipitate is cold ground for about 1 to about 36 hours, and preferably 2 to 6 hours. Additional liquid may be added at any step during the preparation of the liquid developer to facilitate grinding or to dilute the developer to the appropriate percent solids needed for developing. Methods for the preparation of toners that can be selected are illustrated in U.S. Pat. Nos.4,760,009; 5,017,451; 4,923,778 and 4,783,389, the disclosures of which are totally incorporated herein by reference.

The charge director can be added during preparation of the mixture and preferably is added subsequent to the preparation of this mixture in amounts of from about 5 milligrams per gram of toner solids to about 500 milligrams per gram of toner solids of resin, pigment and optional charge adjuvant, and preferably 20 to 100 milligrams.

Methods of imaging are also encompassed by the present invention wherein after formation of a latent image on a photoconductive imaging member, reference U.S. Pat. No. 7,306,591, the disclosure of which is totally incorporated herein by reference, the image is developed with the liquid toner illustrated herein by, for example, immersion of the photoconductor therein, followed by transfer and fixing of the image.

The invention will further be illustrated in the following nonlimiting Examples, it being understood that these Examples are intended to be illustrative only and that the invention is not intended to be limited to the materials, conditions, process parameters and the like recited herein. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to give an ESA signal corresponding to a zeta potential of-26 millivolts for a 10 percent (v/v) suspension of LUDOX TM (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by two methods: (1) The Malvern 3600E Particle Sizer manufactured by Malvern, Southborough, Mass. uses laser diffraction light scattering of stirred samples to determine average particle sizes; and (2) Horiba CAPA-500 centrifugal automatic particle analyzer, manufactured by Horiba Instruments, Inc, Irvine, Calif. Since the Malvern and Horiba instruments use different techniques to measure average particle size, the readings may differ. The following correlation of the average size of toner particles (average volume diameter of resin, pigment, and charge additive mixture product) in microns for the two instruments was

| VALUE DETERMINED BY MALVERN 3600E PARTICLE SIZER | EXPECTED RANGE FOR HORIBA CAPA-500 |
|---|---|
| 30 | 9.9 +/− 3.4 |
| 20 | 6.4 +/− 1.9 |
| 15 | 4.6 +/− 1.3 |
| 10 | 2.8 +/− 0.8 |
| 5 | 1.0 +/− 0.5 |
| 3 | 0.2 +/− 0.6 |

Specific embodiments of the invention will now be described in detail. These Examples are intended to be illustrative, and the invention is not limited to the materials, conditions, or process parameters set forth in these embodiments. All parts and percentages are by weight unless otherwise indicated. Control Examples are also provided.

LIQUID TONER PREPARATION 1

One hundred and sixty five point three (165.3) grams of NUCREL 599® (a copolymer of ethylene and methacrylic acid with a melt index at 190° C. of 500 dg/minute, available from E. I. DuPont de Nemours & Company), 56.8 grams of the magenta pigment FANAL PINK TM, 5.1 grams of aluminum stearate WITCO 22 TM (Witco) and 307.4 grams of NORPAR 15 TM, carbon chain of 15 average (Exxon Corporation), are added to a Union Process 1S attritor (Union Process Company, Akron, Ohio) charged with 0.1857 inch (4.76 millimeters) diameter carbon steel balls. The mixture was milled in the attritor, which was heated with running steam through the attritor jacket at 64° to 91° C., for 2 hours and cooled by running water through the attritor jacket to 23° C. An additional 980.1 grams of NORPAR 15 TM were added, and ground in the attritor for an additional 4.5 hours. An additional 1,532 grams NORPAR 15 TM were added and the mixture was separated by the use of a metal grate from the steel balls yielding 7.19 percent solids of resin, pigment, and charge adjuvant liquid toner concentrate. The particle diameter was 2.02 microns average by area as measured with the Horiba Cappa 500.

LIQUID TONER PREPARATION 2

One hundred and seventy-five point three (175.3) grams of NUCREL 599®, a copolymer of ethylene and methacrylic acid with a melt index at 190° C. of 500 dg/minute, available from E. I. DuPont de Nemours & Company, 45.4 grams of the cyan pigment PV FAST BLUE TM, 6.8 grams of aluminum stearate WITCO 22 TM (Witco) and 307.4 grams of NORPAR 15 TM, carbon chain of 15 average (Exxon Corporation), are added to a Union Process 1S attritor (Union Process Company, Akron, Ohio) charged with 0.1857 inch (4.76 millimeters) diameter carbon steel balls. The mixture was milled in the attritor, which was heated with running steam through the attritor jacket at 86° to 96° C., for 2 hours and cooled by running water through the attritor jacket to 16° C.; an additional 980.1 grams of NORPAR 15 TM were added; and ground in the attritor for an additional 4.5 hours. An additional 1,536 grams of NORPAR 15 TM were added, and the mixture was separated by the use of a metal grate from the steel balls yielding liquid toner concentrate of 7.13 percent solids of resin, pigment and charge adjuvant of aluminum stearate. The particle diameter was 2.12 microns average by area as measured with the Horiba Cappa 500.

BASE POLYMER PREPARATION 1 [PREP FOR 99-1]Sequential Group Transfer Polymerization (GTP) of 2-Ethylhexyl Methacrylate (EHMA) and 2-Dimethylaminoethyl Methacrylate (DMAEMA) to Prepare the AB Diblock Copolymer Precursor of Protonated Ammonium or Quaternary Ammonium Block Copolymer Charge Directors AB diblock copolymer precursors were prepared by a standard group transfer sequential polymerization procedure (GTP) wherein the ethylhexyl methacrylate monomer was first polymerized to completion and then the 2-dimethylaminoethyl methacrylate monomer was polymerized onto the living end of the ethylhexyl methacrylate polymer. All glassware was first baked out in an air convection oven at about 120° C. for about 16 to 18 hours.

In a typical procedure, a 2 liter 3-neck round bottom flask equipped with a magnetic stirring football, an Argon inlet and outlet, and a neutral alumina (150 grams) column (later to be replaced by a rubber septum and then a liquid dropping funnel) is charged through the alumina column, which is maintained under a positive Argon flow and sealed from the atmosphere, with 415 grams (2.093 mole) of freshly distilled 2-ethylhexyl methacrylate (EHMA) monomer. Next, 500 milliliters of freshly distilled tetrahydrofuran solvent, distilled from sodium benzophenone, is rinsed through the same alumina column into the polymerization vessel. Subsequently, the GTP initiator comprised of 15 milliliters of methyl trimethylsilyl dimethylketene acetal (22.31 grams; 0.1280 mole) is syringed into the polymerization vessel. The acetal was originally vacuum distilled, and a middle fraction was collected and stored (under Argon) for polymerization initiation purposes. After stirring for about 5 minutes at ambient temperature under a gentle Argon flow, 0.1 milliliter of a 0.66 molar solution of tetrabutylammonium acetate (catalyst) in the same dry tetrahydrofuran was syringed into the polymerization vessel. After an additional hour stirring under Argon, the polymerization temperature peaked at about 50° C. Shortly thereafter, 90 grams (0.572 mole) of freshly distilled 2-dimethylaminoethyl methacrylate (DMAEMA) monomer was dropwise added to the polymerization vessel. The polymerization solution was stirred under Argon for at least 4 hours after the temperature peaked. Then 5 milliliters of methanol were added to quench the live ends of the fully grown copolymer. The above charges of initiator and monomers provide an Mn and average degree of polymerization (DP) for each block. For the EHMA nonpolar B block, the charged $M_n$ is 3,243 and the DP is 16.4, and for the DMAEMA polar A block, the charged $M_n$ is 703 and the DP is 4.5. $^1$H-NMR analysis of a 20 percent (g/dl) $CDCl_3$ solution of the copolymer indicated a 77 to 78 mole percent EHMA content and a 22 to 23 mole percent DMAEMA content. GPC analysis was obtained on a fraction of the 1 to 2 gram sample of isolated polymer using three 250×8 millimeters PHENOMENEX PHENOGEL TM columns in series (100, 500, 1,000 Angstroms) onto which was injected a 10 microliter sample of the block copolymer at 1 percent (weight/volume) in THF. The sample was eluted with THF at a flow rate of 1 milliliter/minute and the chromatogram was detected with a 254 nanometer UV detector. GPC analysis indicated the major peak at 14.5 to 19.9 counts to have a number average molecular weight of 3,912 and a weight average molecular weight of 6,222 (MWD of 1.59). Two barely discernable broad low molecular weight peaks were located at 20 to 25.1 and 25.1 to 30 counts.

A small (1 to 2 grams) portion of the AB diblock copolymer can be isolated for GPC and $^1$H-NMR analysis by precipitation into 10 times its solution volume of methanol using vigorous mechanical agitation. The precipitated copolymer was then washed on the funnel with more methanol and was then dried overnight in vacuo (about 0.5 Torr) at about 50° C.

The AB diblock copolymer prepared above was not isolated but instead was solvent exchanged to provide a copolymer solution in toluene. Typically, the methanol quenched copolymer solution in tetrahydrofuran was rotoevaporated at about 50° C. at reduced pressure (40 to 50 millimeters Hg) in a tared round bottom flask until no more solvent distilled over. Then toluene was added to provide about a 50 percent by weight solution of the unprotonated block copolymer.

BASE POLYMER PREPARATION 2 [PREP FOR 19-1]

An AB diblock copolymer was prepared as described above using the same polymerization procedure and conditions except the polymerization scale was increased by a factor of three. $^1$H-NMR analysis of a 17.5 percent (g/dl) $CDCl_3$ solution of an isolated portion of the unprotonated block copolymer indicated about a 77 to 78 mole percent EHMA repeat unit content and a 22 to 23 mole percent DMAEMA repeat unit content. GPC analysis, as described in Preparation 1, indicated a major peak at 14.4 to 22.6 counts to have a number average molecular weight of 2,253 and a weight average molecular weight of 5,978 (MWD of 2.65). A broad low molecular weight peak was located at 24 to 32 counts.

CHARGE DIRECTOR PREPARATION 1
Preparation of Methyl Bromide Ammonium Charqe Director The methyl bromide quaternized EHMA-DMAEMA charge director was prepared as follows. To a 1 liter Erlenmeyer flask were added 150 grams of a 50.86 weight percent toluene solution of an AB diblock copolymer (from Preparation 2 above) comprised of 18.23 weight percent of 2-dimethylaminoethyl methacrylate (DMAEMA) repeat units and 81.77 weight percent of 2-ethylhexyl methacrylate (EHMA) repeat units. The 76.29 grams of AB diblock copolymer in the above toluene solution contains 13.91 grams (0.08846 mole) DMAEMA repeat units. To this magnetically stirred solution at room temperature were added an additional 207 grams of toluene (21.4 percent copolymer solution) and 46.2 milliliters (0.0924 mole) of a 2 molar solution of methyl bromide in t-butyl methyl ether. The charged mole percent ratio of methyl bromide to DMAEMA repeat units is 104.5 mole percent so that all of the DMAEMA repeat units have been targeted for conversion to the methyl bromide quaternized AB diblock copolymer charge director. After stirring for 21 hours at ambient conditions in the stoppered Erlenmeyer flask, the clear solution was rotoevaporated for 2 hours at 50° to 55° C. and 30 to 50 millimeters of Hg to remove the excess methyl bromide and toluene. The solid residue was dried in vacuo at 50° to 55° C. for 2.5 to 3.0 hours at about 0.3 millimeter Hg to give 89.62 grams (theory 84.69 grams) of solid methyl bromide quaternized charge director containing 4.93 grams (5.5 weight percent) of trapped toluene. $^1$H-NMR analysis indicated no unquaternized DMAEMA. The copolymer composition was comprised of 26.34 weight percent (21.95 mole percent) of DMAEMA repeat units and 73.66 weight percent (78.05 mole percent) of EHMA repeat units.

The following phase transfer bromide ion exchange hydration treatment was carried out on the methyl bromide quaternary ammonium charge director described above. To a 1.5 liter beaker was added 10.00 grams of the untreated solid methyl bromide quaternized charge director prepared in Example IA plus 100 grams of toluene. The 10.00 grams are 9.45 grams of solid charge director and 0.55 gram of toluene and contains 2.49 grams of (0.0099 mole) DMAEMA repeat units. To the magnetically stirred solution of quaternized charge director in toluene was added a solution of sodium bromide (107.52 grams; 1.045 mole) in deionized water (275 grams) plus 0.065 gram of 40 percent aqueous tetra n-butylammonium hydroxide phase transfer catalyst. After stirring at ambient conditions for 21 hours, the two liquid layers were separated and the aqueous layer was re-extracted with 200 milliliters of toluene and the combined toluene layers were rotoevaporated to dryness. The residual solid was briefly swirled with 200 milliliters of deionized water which was decanted and then 200 milliliters of toluene were added and rotoevaporated away azeotropically removing loosely bound water, not water of hydration, from the solid residue. After drying in vacuo for 2.5 hours at 55° C. and 0.3 millimeter Hg, the solid charge director weighed 10.59 grams (theory 9.45 grams). This phase transfer bromide exchanged methyl bromide quaternized charge director contains about 10.8 percent of trapped toluene/water. Accounting for trapped solvents, a charge director solution was prepared by dissolving 4.68 grams of the solid charge director in 417.8 grams of NORPAR 15 TM to provide a 0.89 percent solution based on the corresponding weight of pre-quaternized AB diblock copolymer.

CHARGE DIRECTOR PREPARATION 2
Preparation of Methyl Hydroxide Ammonium Charge Director The methyl hydroxide quaternized EHMA-DMAEMA charge director was prepared as follows. To a 1.5 liter beaker was added 10.00 grams of the untreated solid methyl bromide quaternized methyl bromide ammonium charge director described above plus 100 grams of toluene. The 10.00 grams is 9.45 grams of solid charge director and 0.55 gram of toluene and contains 2.49 grams (0.0099 mole) of DMAEMA repeat units. To the magnetically stirred solution of quaternized charge director in toluene was added an ambient temperature solution of sodium hydroxide flake (41.80 grams; 1.045 mole) in deionized water (229 grams) plus 0.065 gram of 40 percent of aqueous tetra n-butylammonium hydroxide phase transfer catalyst. After stirring at ambient conditions for 17.5 hours, about 75 grams of toluene were added and the two liquid layers were separated. The aqueous layer was re-extracted with 150 grams of toluene and the combined toluene layers were rotoevaporated to dryness. The residual solid was briefly swirled with 150 to 200 milliliters deionized water which was decanted (pH of 7 to 8) and then 150 to 200 milliliters of toluene were added and rotoevaporated away azeotropically removing loosely bound water, not water of hydration, from the solid residue. After drying in vacuo for 2.5 hours at 55° C. and 0.3 millimeter of Hg, the solid methyl hydroxide quaternized charge director weighed 8.99 grams (theory 8.83 grams). The solid charge director contains about 1.8 weight percent trapped water/toluene. This small amount of solvent residue was ignored in preparing the charge director solution. A charge director solution was prepared by dissolving 3.38 grams of the solid charge director in 322.7 grams of NORPAR 15 TM to give a 1 percent solution based on the corresponding weight of pre-quaternized AB diblock copolymer. The 1 percent charge director solution in NORPAR 15 TM had a conductivity of 330.

Control 1

A liquid toner dispersion was prepared by selecting 208.6 grams of liquid toner concentrate (7.19 percent of solids in NORPAR 15 TM ) from Liquid Toner Preparation 1 and adding to it 1,246.4 grams of NORPAR 15 TM , and 45.0 grams of charge director ( 1 percent of solids in NORPAR 15 TM ) from Charge Director Preparation 1. This resulted in a liquid toner dispersion of 1 percent of solids and 30 milligrams of charge director to 1 gram of toner solids. After 1 week of equilibration, a test was conducted to determine the toner charging rate. The 1 percent toner was charged to a 90 milligrams/gram level and the mobility of the toner was determined as a function of time. The results are presented in Table 1 below.

EXAMPLE I

A liquid toner dispersion was prepared by selecting 208.6 grams of liquid toner concentrate (7.19 percent of solids in NORPAR 15 TM ) from Liquid Toner Preparation 1 and adding to it 1,246.4 grams of NORPAR 15 TM , and 45.0 grams of charge director (1 percent solids in NORPAR 15 TM ) from Charge Director Preparation 2. This resulted in a liquid toner dispersion of percent of solids and 30 milligrams of charge director to 1 gram of toner solids. After 1 week of equilibration, a test was conducted to determine the toner charging rate. The 1 percent toner was charged to a 90 milligrams/gram level and the mobility of the toner was determined as a function of time. The results are presented in Table 1 below. These results evidence that the hydroxide charge director charges the toner faster than the bromide charge director and that it maintains a high charge at a lower conductivity.

TABLE 1

| EXAMPLE | Equilibration Time After Toners are Charged from 30 mg/g to 90 mg/g | Mobility (E-10 $m^2/Vs$) | Conductivity pmho/cm |
|---|---|---|---|
| Control 1 | 30 min. | −0.65 | 15 |
| | 1 day | −1.09 | 18 |
| | 71 days | −1.77 | 19 |
| Example I | 30 min. | −0.98 | 15 |
| | 1 day | −1.65 | 13 |
| | 71 days | −1.72 | 13 |

Control 2

A liquid toner dispersion was prepared by selecting 28.1 grams of liquid toner concentrate (7.13 percent of solids in NORPAR 15 TM ) from Liquid Toner Preparation 2 and adding to it 161.9 grams of NORPAR 15 TM , and 10 grams of charge director (1 percent of solids in NORPAR 15 TM ) from Charge Director Preparation 1. This resulted in a liquid toner dispersion of 1 percent of solids and 50 milligrams of charge director to 1 gram of toner solids. The conductivity and mobility of this toner and that of Example II were measured. The results are presented in Table 2 below.

EXAMPLE II

A liquid toner dispersion was prepared by selecting 28.1 grams of liquid toner concentrate (7.13 percent of solids in NORPAR 15 TM ) from Liquid Toner Preparation 1 and adding to it 161.9 grams of NORPAR 15 TM , and 28.1 grams of charge director ( 1 percent of solids in NORPAR 15 TM ) from Charge Director Preparation 2. This resulted in a liquid toner dispersion of 1 percent of solids and 50 milligrams of charge director to 1 gram of toner solids. The conductivity and mobility of this toner were measured. The results are presented in Table 2 below. These results evidence that the hydroxide charge director charges the toner faster than the bromide charge director and that it maintains a high charge at a lower conductivity.

TABLE 2

| EXAMPLE | Equilibration Time After Toners are Charged to 50 mg/g. | Mobility (E-10 $m^2/Vs$) | Conductivity pmho/cm |
|---|---|---|---|
| Control 2 | 2 days | −1.80 | 14 |
| | 9 days | −1.78 | 13 |
| | 39 days | −2.07 | 12 |
| Example II | 2 days | −1.99 | 11 |
| | 9 days | −1.86 | 10 |
| | 39 days | −2.43 | 10 |

Other embodiments and modifications of the present invention may occur to those skilled in the art subsequent to a review of the information presented herein; these embodiments and modifications, as well as equivalents thereof, are also included within the scope of this invention.

What is claimed is:

1. A liquid developer comprised of a liquid, thermoplastic resin particles, a nonpolar liquid soluble charge director, comprised of a quaternary ammonium block copolymer with hydroxide as the anion.

2. A liquid developer comprised of a nonpolar liquid, thermoplastic resin particles, a charge adjuvant, and a nonpolar liquid soluble ionic charge director comprised of a quaternary ammonium block copolymer with hydroxide as the anion.

3. A liquid electrostatographic developer comprised of (A) a nonpolar liquid having a Kauri-butanol value of from about 5 to about 30 and present in a major amount of from about 50 percent to about 95 weight percent; (B) thermoplastic resin particles having an average volume particle diameter of from about 5 to about 30 microns; (C) a nonpolar liquid soluble ionic charge director compound comprised of a quaternary ammonium block copolymer with hydroxide as the anion; and (D) a charge adjuvant.

4. A developer in accordance with claim 3 wherein the charge director is of the formula

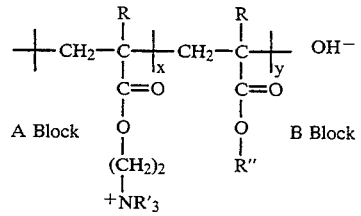

wherein R is alkyl or hydrogen; R′ is alkyl; and R″ is alkyl with from 6 to about 20 carbon atoms; and wherein y and x represent the number average degree of polymerization wherein the ratio of x to y is in the range of from about 10 to 2 to about 100 to 20.

5. A developer in accordance with claim 4 wherein the charge adjuvant is aluminum stearate.

6. A developer in accordance with claim 2 wherein the resin particles are comprised of a copolymer of ethylene and an $\alpha$, $\beta$ethylenically unsaturated acid selected from the group consisting of acrylic acid and methacrylic acid.

7. A developer in accordance with claim 2 wherein the resin particles are comprised of a styrene polymer, an acrylate polymer, a methacrylate polymer, a polyester, or mixtures thereof.

8. A developer in accordance with claim 3 wherein the resin is comprised of a copolymer of ethylene and vinyl acetate, polypropylene, polyethylene or acrylic polymers.

9. A developer in accordance with claim 2 wherein the resin is comprised of a copolymer of ethylene, and acrylic or methacrylic acid, an alkyl ester of acrylic or methacrylic acid wherein alkyl contains from 1 to about 5 carbon atoms or a copolymer of ethylene, and methacrylic acid with a melt index at 190° C. of 500.

10. A developer according to claim 2 further containing a colorant.

11. A developer according to claim 10 wherein the colorant is a pigment or a dye.

12. A developer in accordance with claim 11 wherein the pigment is cyan, magenta, yellow, red, green, blue, brown, or mixtures thereof, or carbon black.

13. A developer in accordance with claim 2 wherein the charge director is present in an amount of from about 2 to about 10 weight percent, and there is enabled a negatively charged toner.

14. A developer in accordance with claim 3 wherein component (A) is present in an amount of from 85 percent to 99.9 percent by weight based on the total weight of the developer solids of resin, optional pigment, and charge adjuvant which is present in an amount of from about 0.1 percent to about 15 percent by weight; and component (C) is present in an amount of from about 0.25 to about 1,500 milligrams/gram of the developer solids comprised of resin, pigment, and charge adjuvant.

15. A developer in accordance with claim 3 wherein component (D) is present in an amount of 0.1 to 40 percent by weight based on the total weight of developer solids.

16. A developer in accordance with claim 2 wherein the liquid is an aliphatic hydrocarbon.

17. A developer in accordance with claim 16 wherein the aliphatic hydrocarbon is a mixture of branched hydrocarbons with from about 12 to about 16 carbon atoms.

18. A developer in accordance with claim 16 wherein the aliphatic hydrocarbon is a mixture of normal hydrocarbons with from about 12 to about 16 carbon atoms.

19. A developer in accordance with claim 3 wherein component (C) is an oil-soluble petroleum sulfonate.

20. A developer in accordance with claim 3 wherein the resin is an alkylene polymer, a styrene polymer, an acrylate polymer, a polyester, or mixtures thereof.

21. An imaging method which comprises forming an electrostatic latent image followed by the development thereof with the liquid developer of claim 2.

22. An imaging method which comprises forming an electrostatic latent image followed by the development thereof with the liquid developer of claim 3.

23. A developer in accordance with claim 3 wherein the charge director is selected from the group consisting of poly[2-trimethylammoniumethyl methacrylate hydroxide co-2-ethylhexyl methacrylate], poly[2-triethylammoniumethyl methacrylate hydroxide co-2-ethylhexyl methacrylate], poly[2-trimethylammoniumethyl methacrylate hydroxide co-2-ethylhexyl methacrylate], poly[2-trimethylammoniumethyl methacrylate hydroxide co-2-ethylhexyl acrylate], poly[2-trimethylammoniumethyl acrylate hydroxide co-2-ethylhexyl methacrylate], poly[2-trimethylammoniumethyl acrylate hydroxide co-2-ethylhexyl acrylate], poly[2-trimethylammoniumethyl methacrylate hydroxide co-2-ethylhexyl acrylate], poly[2-triethylammoniumethyl acrylate hydroxide co-2-ethylhexyl acrylate], poly[2-triethylammoniumethyl methacrylate hydroxide co-2-ethylhexyl acrylate], poly[2-trimethylammoniumethyl acrylate hydroxide co-2-ethylhexyl acrylate], poly[2-trimethylammoniumethyl methacrylate hydroxide co-N,N-dibutyl methacrylamide], poly[2-triethylammoniumethyl methacrylate hydroxide co-N,N-dibutyl methacrylamide], poly[2-trimethylammoniumethyl methacrylate hydroxideco-N,N-dibutylacrylamide], and poly[2-triethylammoniumethyl methacrylatehydroxide co-N,N-dibutylacrylamide].

24. A developer in accordance with claim 3 wherein said A block has a number average molecular weight range of from about 200 to about 10,000, and said B block has a number average molecular weight range of from about 2,000 to about 50,000.

25. A liquid developer consisting essentially of a nonpolar liquid, thermoplastic resin particles, a charge adjuvant, and a nonpolar liquid soluble ionic charge director comprised of a quaternary ammonium block copolymer with hydroxide as the anion; and wherein said quaternary ammonium block copolymer is of the formula

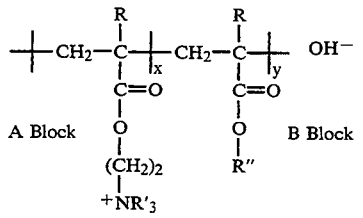

wherein R is alkyl or hydrogen; R′ is alkyl; and R″ is alkyl with from 6 to about 20 carbon atoms; and wherein y and x represent the number average degree of polymerization, and wherein the ratio of x to y is in the range of from about 10 to 2 to about 100 to 20.

26. A developer in accordance with claim 25 wherein said charge director is selected from the group consisting of poly[2-trimethylammoniumethyl methacrylate hydroxide co-2-ethylhexyl methacrylate], poly[2-triethylammoniumethyl methacrylate hydroxide co-2-ethylhexyl methacrylate], poly[2-trimethylammoniumethyl methacrylate hydroxide co-2-ethylhexyl methacrylate], poly[2-trimethylammoniumethyl methacrylate hydroxide co-2-ethylhexyl acrylate], poly[2-trimethylammoniumethyl acrylate hydroxide co-2-ethylhexyl methacrylate], poly[2-trimethylammoniumethyl acrylate hydroxide co-2-ethylhexyl acrylate], poly[2-trimethylammoniumethyl methacrylate hydroxide co-2-ethylhexyl acrylate], poly[2-triethylammoniumethyl acrylate hydroxide co-2-ethylhexyl acrylate], poly[2-triethylammoniumethyl methacrylate hydroxide co-2-ethylhexyl acrylate], poly[2-trimethylammoniumethyl acrylate hydroxide co-2-ethylhexyl acrylate], poly[2-trimethylammoniumethyl methacrylate hydroxide co-N,N-dibutyl methacrylamide], poly[2-triethylammoniumethyl methacrylate hydroxide co-N,N-dibutyl methacrylamide], poly[2-trimethylammoniumethyl methacrylate hydroxideco-N,N-dibutylacrylamide], and poly[2-triethylammoniumethyl methacrylatehydroxide co-N,N-dibutylacrylamide].

* * * * *